US005630964A

United States Patent [19]

Babaian-Kibala et al.

[11] Patent Number: 5,630,964

[45] Date of Patent: May 20, 1997

[54] USE OF SULFIDING AGENTS FOR ENHANCING THE EFFICACY OF PHOSPHORUS IN CONTROLLING HIGH TEMPERATURE CORROSION ATTACK

[75] Inventors: Elizabeth Babaian-Kibala, Fulshear; John G. Hyatt, Missouri City, both of Tex.; Theodore J. Rose, Moores Town, N.J.

[73] Assignee: Nalco/Exxon Energy Chemicals, L.P., Sugarland, Tex.

[21] Appl. No.: 435,405

[22] Filed: May 10, 1995

[51] Int. Cl.[6] ..... C23F 11/16; C23F 11/167

[52] U.S. Cl. ..... 252/389.23; 252/395; 422/7; 208/47; 585/950

[58] Field of Search ..... 252/389.23, 395; 422/7; 208/47; 203/7; 585/950

[56] References Cited

U.S. PATENT DOCUMENTS

| | | | |
|---|---|---|---|
| 2,656,380 | 10/1953 | Turner et al. | 260/514 |
| 2,973,316 | 2/1961 | Howland | 208/47 |
| 3,228,758 | 1/1966 | Bauer | 208/47 |
| 3,553,150 | 1/1971 | Rosenwald et al. | 208/47 |
| 3,684,687 | 8/1972 | Carr et al. | 208/47 |
| 4,024,050 | 5/1977 | Shell et al. | 208/48 |
| 4,024,051 | 5/1977 | Shell et al. | 208/348 |
| 4,600,518 | 7/1986 | Ries et al. | 252/34 |
| 4,842,716 | 6/1989 | Kaplan et al. | 208/47 |
| 4,941,994 | 7/1990 | Zertlmial et al. | 252/389.23 |
| 5,182,013 | 1/1993 | Petersen et al. | 208/348 |
| 5,188,179 | 2/1993 | Gay et al. | 208/47 |
| 5,252,254 | 10/1993 | Babaian Kibala | 208/47 |
| 5,314,643 | 5/1994 | Edmondson et al. | 252/389.23 |
| 5,464,525 | 11/1995 | Edmondson | 208/47 |
| 5,500,107 | 3/1996 | Edmondson | 208/47 |

OTHER PUBLICATIONS

Scattergood, G. L. et al "Naphthenic Acid Corrosion, An Update of Control Methods" Corrosion 87; Mar. 9–13, 1987: Moscone Center/San Francisco, CA; Paper No. 197.

Piehl, R. L. "Naphthenic Acid Corrosion in Crude Distillation Units" Corrosion 87; Mar. 9–13, 1987: Moscone Center/San Francisco, CA; Paper No. 196.

Guestavsen, A. J. et al "Review of Sulfonates as Corrosion Inhibitors" Corrosion 89; Apr. 17–21, 1987: New Orelans Convention Center, New Orleans, Louisiana; Paper No. 449.

Babaian–Kibala, et al "Naphthenic Acid Corrosion in a Refinery Setting" Corrosion 93; NACE Annual Conference . . . ; Paper No. 631 (1993).

Craig, H. Lee et al: "Naphthenic Acid Corrosion in the Refinery" Corrosion 95; Nace international Annual Conference . . . , Paper No. 333 (1995).

*Primary Examiner*—Sharon Gibson
*Assistant Examiner*—Valerie Fee
*Attorney, Agent, or Firm*—Robert A. Miller; James J. Drake; Patricia A. Charlier

[57] ABSTRACT

The invention comprises a method of inhibiting naphthenic acid corrosion in a high temperature hydrocarbon system, comprising adding to the system a corrosion-inhibiting amount of a phosphate ester and a corrosion-inhibiting amount of organic polysulfide.

15 Claims, 1 Drawing Sheet

USE OF SULFIDING AGENTS FOR ENHANCING THE EFFICACY OF PHOSPHORUS IN CONTROLLING HIGH TEMPERATURE CORROSION ATTACK

The present invention relates generally to the use of sulfiding agents for enhancing the efficacy of phosphorus in controlling high temperature attack. The corrosion agents utilized in combination are a phosphate ester and an organic polysulfide.

BACKGROUND OF THE INVENTION

Naphthenic acid corrosion has plagued the refining industry for many years. This corroding material consists of predominantly monocyclic or bicyclic carboxylic acids with a boiling range between 350° and 650° F. These acids tend to concentrate in the heavier fractions during crude distillation. Thus, locations such as the furnace tubing, transfer lines, fractionating tower internals, feed and reflux sections of columns, heat exchangers, tray bottoms and condensors are primary sites of attack for naphthenic acid. Additionally, when crude stocks high in naphthenic acids are processed, severe corrosion can occur in the carbon steel or ferritic steel furnace tubes and tower bottoms. Recently interest has grown in the control of this type of corrosion in hydrocarbon processing units due to the presence of naphthenic acid in crudes from locations such as China, India and Africa.

Crude oils are hydrocarbon mixtures which have a range of molecular structures and consequent range of physical properties. The physical properties of naphthenic acids which may be contained in the hydrocarbon mixtures also vary with the changes in molecular weight, as well as the source of oil containing the acid. Therefore, characterization and behavior of these acids are not well understood. A well known method used to "quantify" the acid concentration in crude oil has been a KOH titration of the oil. The oil is titrated with KOH, a strong base, to an end point which assures that all acids in the sample have been neutralized. The unit of this titration is mg. of KOH/gram of sample and is referred to as the "Total Acid Number" (TAN) or Neutralization Number. Both terms are used interchangeably in the application.

The unit of TAN is commonly used since it is not possible to calculate the acidity of the oil in terms of moles of acid, or any other of the usual analytical terms for acid content. Refiners have used TAN as a general guideline for predicting napthenic acid corrosion. For example, many refineries blend their crude to a TAN=0.5 assuming that at these concentrations naphthenic acid corrosion will not occur. However, this measure has been unsuccessful in preventing corrosion by naphthenic acid.

Naphthenic acid corrosion is very temperature dependent. The generally accepted temperature range for this corrosion is between 205° C. and 400° C. (400° F. and 750° F.). Corrosion attack by these acids below 205° C. has not yet been reported in the published literature. As to the upper boundary, data suggests that corrosion rates reach a maximum at about 600°–700° F. and then begin to diminish.

The concentration and velocity of the acid/oil mixture are also important factors which influence naphthenic acid corrosion. This is evidenced by the appearance of the surfaces effected by naphthenic acid corrosion. The manner of corrosion can be deduced from the patterns and color variations in the corroded surfaces. Under some conditions, the metal surface is uniformly thinned. Thinned areas also occur when condensed acid runs down the wall of a vessel. Alternatively, in the presence of naphthenic acid pitting occurs, often in piping or at welds. Usually the metal outside the pit is covered with a heavy, black sulfide film, while the surface of the pit is bright metal or has only a thin, grey to black film covering it. Moreover, another pattern of corrosion is erosion-corrosion, which has a characteristic pattern of gouges with sharp edges. The surface appears clean, with no visible by-products. The pattern of metal corrosion is indicative of the fluid flow within the system, since increased contact with surfaces allows for a greater amount of corrosion to take place. Therefore, corrosion patterns provide information as to the method of corrosion which has taken place. Also, the more complex the corrosion, i.e., in increasing complexity from uniform to pitting to erosion-corrosion, the lower is the TAN value which triggers the behavior.

The information provided by corrosion patterns indicates whether naphthenic acid is the corroding agent, or rather if the process of corrosion occurs as a result of attack by sulfur. Most crudes contain hydrogen sulfide, and therefore readily form iron sulfide films on carbon steel. In all cases that have been observed in the laboratory or in the field, metal surfaces have been covered with a film of some sort. An analysis of a typical film is shown in FIGURE 1. In the presence of hydrogen sulfide the film formed is invariably iron sulfide, while in the few cases where tests have been run in sulfur free conditions, the metal is covered with iron oxide, as there is always enough water or oxygen present to produce a thin film on the metal coupons.

Tests utilized to determine the extent of corrosion may also serve as indicators of the type of corrosion occurring within a particular hydrocarbon treating unit. Metal coupons can be inserted into the system. As they are corroded, they lose material. This weight loss is recorded in units of $mg/cm^2$. Thereafter, the corrosion rate can be determined from weight loss measurements. Then the ratio of corrosion rate to corrosion product ($mpy/mg/cm^2$) is calculated. This is a further indicator of the type of corrosion process which has taken place, for if this ratio is less than 10, it has been found that there is little or no contribution of naphthenic acid to the corrosion process. However, if the ratio exceeds 10, then naphthenic acid is a significant contributor to the corrosion process.

Distinguishing between sulfidation attack and corrosion caused by naphthenic acid is important, since different remedies are required depending upon the corroding agent. Usually, retardation of corrosion caused by sulfur compounds at elevated temperatures is effected by increasing the amount of chromium in the alloy which is used in the hydrocarbon treating unit. A range of alloys may be employed, from 1.25% Cr to 12% Cr, or perhaps even higher. Unfortunately, these show little to no resistance to naphthenic acid. To compensate for the corroding effects of sulfur and naphthenic acid, an austenitic stainless steel which contains at least 2.5% molybdenum, must be utilized. See Craig, NACE Corrosion 95 meeting, paper no. 333, 1995. To avoid the cost of the use of heavy metal alloys throughout the hydrocarbon treating unit for the prevention of corrosion, effective alternatives have been sought.

One approach involves blending low acid number oils with corrosive high acid number oils to reduce the overall neutralization number.

An alternative approach is to utilize an effective chemical treatment to combat naphthenic acid corrosion. U.S. Pat. No. 4,600,518 discloses choline as an effective agent for neutralizing naphthenic acids found in certain fuel and lubricating oils.

Another approach to the prevention of naphthenic acid corrosion is the use of a chemical agent to form a barrier between the crude and the equipment of the hydrocarbon processing unit. This barrier or film prevents corrosive agents from reaching the metal surface, and is generally a hydrophobic material. Gustavsen et al. NACE Corrosion 89 meeting, paper no. 449, Apr. 17–21, 1989 details the requirements for a good filming agent. U.S. Pat. No. 5,252,254 discloses one such film forming agent, sulfonated alkyl-substituted phenol, effective against naphthenic acid corrosion.

Phosphorus-containing naphthenic acid corrosion inhibitors are disclosed in Zetlmeisl et al., U.S. Pat. No. 4,941,994. Dialkyl or trialkyl phosphites alone or in conjunction with a thiazoline were used to prevent corrosion on metal surfaces.

Phosphate and phosphite mono- and di-esters in small amounts are disclosed as antifoulant additives in crude oil systems employed as feedstocks in petroleum refining in Shell et al., U.S. Pat. No. 4,024,050. Inorganic phosphorus-containing acids and salts in small amounts were also found to be useful as antifoulants in crude oil systems in Shell et al., U.S. Pat. No. 4,024,051. The disclosures of U.S. Pat. Nos. 4,024,050 and 4,024,051 are incorporated herein by reference.

U.S. Pat. No. 5,182,013 issued to Petersen et al. on Jan. 26, 1993 describes another method of inhibiting naphthenic acid corrosion of crude oil, comprising introducing into the oil an effective amount of an organic polysulfide. The disclosure of U.S. Pat. No. 5,182,013 is incorporated herein by reference. This is another example of a corrosion-inhibiting sulfur species. Sulfidation as a source of corrosion was detailed above. Though the process is not well understood, it has been determined that while sulfur can be an effective anti-corrosive agent in small quantities, at sufficiently high concentrations, it becomes a corrosion agent.

Phosphorus can form an effective barrier against corrosion without sulfur, but the addition of sulfiding agents to the process stream containing phosphorus yields a film composed of both sulfides and phosphates. This results in improved performance as well as a decreased phosphorus requirement. This invention pertains to the deliberate addition of sulfiding agents to the process stream when phosphorus-based materials are used for corrosion control to accentuate this interaction.

SUMMARY OF THE INVENTION

The invention comprises a method of inhibiting naphthenic acid corrosion in a high temperature hydrocarbon system, comprising adding to the system a corrosion-inhibiting amount of a phosphate ester and a corrosion-inhibiting amount of organic polysulfide.

DESCRIPTION OF THE INVENTION

Figure 1:
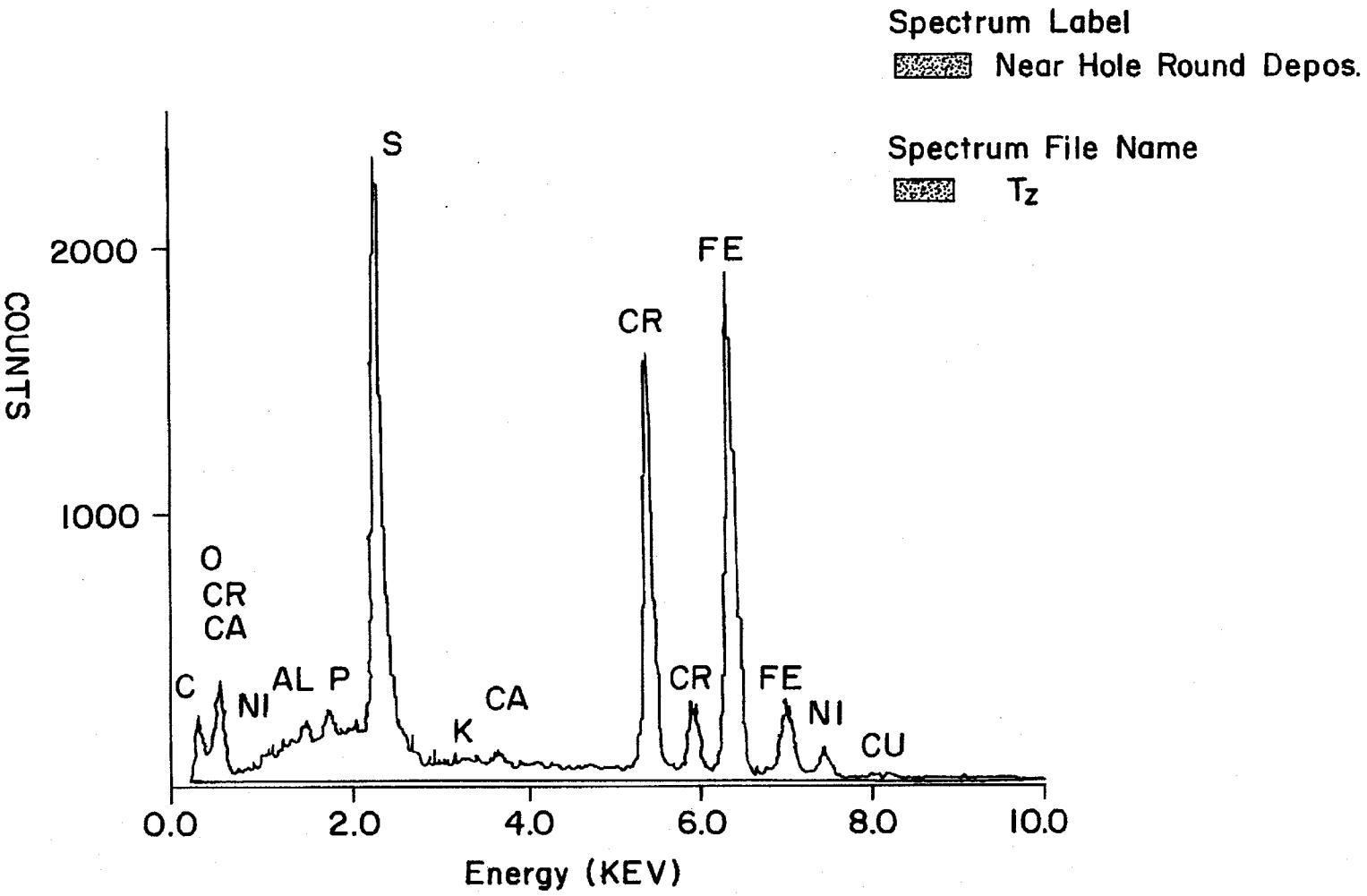
FIGURE 1 is an elemental analysis of the composition of typical film found on the outside of a pit.

The invention comprises a method of inhibiting naphthenic acid corrosion in a high temperature hydrocarbon system, comprising adding to the system a corrosion-inhibiting amount of a phosphate ester and organic polysulfide.

A method of inhibiting naphthenic acid corrosion in a high temperature hydrocarbon system; comprising adding simultaneously to the system a) corrosion-inhibiting amount of a phosphate ester of the formula

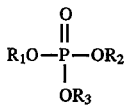

where $R_1$ and $R_2$ are each independently selected from the group consisting of hydrogen and moieties having from one to thirty carbon atoms, and $R_3$ is a moiety having from one to thirty carbon atoms; and b) a corrosion-inhibiting amount of an organic polysulfide. When $R_1$, $R_2$ and $R_3$ are carbon containing moieties, they may be selected from the group consisting of alkyl, arylalkyl, alkylaryl and aryl groups having from one to thirty carbon atoms.

The ratio of said polysulfide to said phosphate ester ranges from 4:0.25 to 0.25:4. Preferably, the ratio of the polysulfide to the phosphate ester ranges from 3:1 to 0.25:4. Most preferably, the ratio of polysulfide to the phosphate ester ranges from 1:1 to 1:4. The velocity of the hydrocarbon stream treated is from about 5 to about 250 feet per second. The phosphate group of the phosphate ester is selected from the group consisting of phosphate, diphosphate, triphosphate, thiophosphate, dithiophosphate and trithiophosphate. Typical examples of other suitable phosphate esters include: methyl phosphate, ethyl phosphate, n-propyl phosphate, iso-propyl phosphate, butyl phosphate, pentyl phosphate, hexyl phosphate, cylcohexyl phosphate, heptyl phosphate, nonyl phosphate, decyl phosphate, lauryl phosphate, cetyl phosphate, octadecyl phosphate, heptadecyl phosphate, phenyl phosphate, benzyl phosphate, tolyl phosphate, methyl phenyl phosphate, and amyl phenyl phosphate. The specific listing of a given monoester here is intended to include the listing of the corresponding diester as well; thus, for example methyl phosphate is intended to include dimethyl phosphate. The amount of phosphate ester added to the hydrocarbon stream is from 5 to 500 ppm. Preferably, the amount of phosphate ester added to the hydrocarbon stream is from 5 to 200 ppm. Most preferably, the amount of phosphate ester added to the hydrocarbon stream is from 10 to 50 ppm.

The polysulfide is of the formula $R_4—(S)_x—R_5$ wherein $R_4$ and $R_5$ are selected from the group consisting of alkyl groups having from 6 to 30 carbon atoms, cycloalkyl groups having from 6 to 30 carbon atoms and aromatic groups; and wherein x ranges from 2 to 6. The preferred polysulfides are those in which the $R_4$ and $R_5$ groups are alkyl and cycloalkyl groups. The most preferred polysulfides are those wherein both $R_4$ and $R_5$ are the same. The sulfur content of the polysulfide ranges from 10 to 60%, preferably 25 to 50%, by weight. The preferred polysulfides include the following: olefin polysulfides and terpene polysulfides. The molecular weight of the polysulfides useful in the method of the present invention may range from 200 to 800, preferably, 300 to 600. The polysulfides are soluble in a variety of oils and therefore may be introduced as an oil soluble package. Preferred carriers are aromatic solvents such as xylenes. Generally, the polysulfide will constitute from 20 to 70 weight percent of the package. The amount of polysulfide added to the hydrocarbon stream is from 25 to 2000 ppm. Preferably, the amount of polysulfide added to the hydrocarbon stream is from 50 to 200 ppm. Most preferably, the amount of polysulfide added to the hydrocarbon stream is from 10 to 50 ppm.

The following examples are presented to describe preferred embodiments and utilities of the invention and are not meant to limit the invention unless otherwise stated in the claims appended hereto.

EXAMPLE 1

To assess the corrosion behavior of process streams derived from various crudes a test which provides a standard method of determining corrosivity was used. The test is based on NACE Standard TM-01-69, "Test Method—Laboratory Corrosion Testing of Metals for the Process Industries". The conditions of testing are standardized within the commonly known parameters for naphthenic acid corrosion.

| PARAMETERS[1] | STANDARD TEST CONDITIONS |
|---|---|
| TAN >0.5 mg KOH/g oil | TAN = 5.0 |
| Temperature 450° F. to 750° F. | T = 500° F. |
| Test period (laboratory suitable) | 48 hours |
| Flow conditions | quiescent |
| Atmosphere (to prevent oxidation) | Nitrogen |
| Coupon surface/oil volume ratio | 10 sq cm/250 ml |

[1] = The conditions of testing are standardized within the commonly known parameters for napthenic acid corrosion.

To determine corrosion values, a hydrocarbon fluid was prepared by using viscous oil and commercially available naphthenic acid.

Several commercially available naphthenic acids were first tested, each at a nominal TAN value equal to 5 mg KOH/gram of oil, prepared by dilution with a neutral mineral oil. The corrosion rates varied from a low of 13.3 mpy to a high of 53.9 mpy, as can be seen in Table 1.

TABLE 1

| COMMERCIAL BRAND OF NAPTHENIC ACID[1] | CORROSION RATE (MPY) |
|---|---|
| Brand A, Lot A | 13.3 |
| Brand A. Lot B | 33.7 |
| Brand A, Lot C | 23.7 |
| Brand B | 25.6 |
| Brand C | 53.9 |

[1] = EACH AT TAN = 5

EXAMPLE 2

A 2-liter, 4-neck round bottom flask equipped with a mechanical stirrer and a Dean-Stark trap connected to a condensor was used. The temperature was controlled by a temperature controller. Test coupons of carbon steel were inserted into the round bottom flask. The temperature of the fluid was raised to 260° C. (500° F.) for 6 hours. The coupon was removed, excess oil was rinsed from it and the excess corrosion products were removed from the coupon by scrubbing with steel wool. The coupon was then weighed and percent inhibition and corrosion rate were calculated.

A commercially available naphthenic acid was used to increase the total acid number of terrestic oil to 12. The system was kept under positive argon pressure. An inhibitor was introduced to the fluid under agitation at 93° C. (200° F.). The temperature was then raised to 260° C. (500° F.) and the procedure was carried out.

The results of the testing are detailed in Table II. Though either phosphate ester or polysulfide alone decreases MPY, signifying a decrease in the corrosion rate, the combination of the two compounds produces a surprising result. The combination almost completely eliminates corrosive activity, in comparison to either compound individually which has only an inhibitory effect.

TABLE II

| Inhibitor | % Inhibition | MPY |
|---|---|---|
| None | 0 | 73.25 |
| 1000 ppm phosphate ester | 68.7 | 29.77 |
| 1000 ppm polysulfide | 20.47 | 58.3 |
| 1000 ppm phosphate ester 500 ppm polysulfide | 98 | 2 |
| 2000 ppm phosphate ester | 60.12 | 28.7 |

Changes can be made in the composition, operation and arrangement of the method of the present invention described herein without departing from the concept and scope of the invention as defined in the following claims:

We claim:

1. A method of inhibiting naphthenic acid corrosion occurring on the metal surfaces of a high temperature hydrocarbon system in contact with a crude oil containing naphthenic acid comprising adding simultaneously to the crude oil:

a) corrosion-inhibiting amount of a phosphate ester of the formula

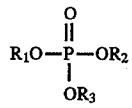

wherein $R_1$ and $R_2$ are each independently selected from the group consisting of hydrogen and moieties having from one to thirty carbon atoms, and $R_3$ is a moiety having from one to thirty carbon atoms; and b) a corrosion inhibiting amount of an organic polysulfide of the formula $R_4$—$(S)_x$—$R_5$ wherein $R_4$ and $R_5$ are selected from the group consisting of alkyl groups having from 6 to 30 carbon atoms, and cycloalkyl groups having from 6 to 30 carbon atoms and x ranges from 2 to 6, and wherein the ratio of such polysulfide to said phosphate ester ranges from 4:0.25 to 0.25:4.

2. The method of claim 1 wherein the velocity of the crude oil is from about 5 to about 250 feet per second.

3. The method of claim 1 wherein the phosphate ester is selected from the group consisting of phosphate, diphosphate, triphosphate, thiophosphate, dithiophosphate and trithiophosphate.

4. The method of claim 3, wherein the amount of ester added to the crude oil is from about 5 to about 500 parts per million.

5. The method of claim 4 wherein the amount of polysulfide added to the crude oil is from 25 to 2000 ppm.

6. A method of inhibiting naphthenic acid corrosion occurring on the metal surfaces of a high temperature hydrocarbon system in contact with a crude oil containing naphthenic acid comprising adding simultaneously to the crude oil:

a) corrosion-inhibiting amount of a phosphate ester of the formula

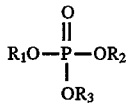

wherein $R_1$ and $R_2$ are each independently selected from the group consisting of hydrogen and moieties having from one to thirty carbon atoms, and $R_3$ is a moiety having form one to thirty carbon atoms; and b) a corrosion inhibiting amount of an organic polysulfide of the formula $R_4$—$(S)_x$—$R_5$ wherein $R_4$ and $R_5$ are selected from the group consisting of alkyl groups having from 6 to 30 carbon atoms, and cycloalkyl groups having from 6 to 30 carbon atoms and x ranges from 2 to 6, and wherein the ratio of such polysulfide to said phosphate ester ranges from 3:1 to 0.25:4.

7. The method of claim 6 wherein the velocity of the crude oil is from about 5 to about 250 feet per second.

8. The method of claim 6 wherein the phosphate ester is selected from the group consisting of phosphate, diphosphate, triphosphate, thiophosphate, dithiophosphate and trithiophosphate.

9. The method of claim 8 wherein the amount of phosphate ester added to the crude oil is from 5 to 200 ppm.

10. The method of claim 9 wherein the amount of polysulfide added to the crude oil is from 5 to 200 ppm.

11. A method of inhibiting naphthenic acid corrosion occurring on the metal surfaces of a high temperature hydrocarbon system in contact with a crude oil containing naphthenic acid comprising adding simultaneously to the crude oil:

a) a corrosion-inhibiting amount of a phosphate ester of the formula

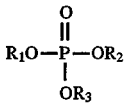

where $R_1$ and $R_2$ are each independently selected from the group consisting of hydrogen and moieties having from one to thirty carbon atoms, and $R_3$ is a moiety having from one to thirty carbon atoms; and b) a corrosion-inhibiting amount of an organic polysulfide of the formula $R_4$—$(S)_x$—$R_5$ wherein $R_4$ and $R_5$ are selected from the group consisting of alkyl groups having from 6 to 30 carbon atoms, and cycloalkyl groups having from 6 to 30 carbon atoms and x ranges from 2 to 6, and wherein the ratio of said polysulfide to said phosphate ester ranges from 1:1 to 1:4.

12. The method of claim 11 wherein the velocity of the crude oil is from about 5 to about 250 feet per second.

13. The method of claim 11 wherein the phosphate ester is selected from the group consisting of phosphate, diphosphate, triphosphate, thiophosphate, dithiophosphate and trithiophosphate.

14. The method of claim 13 wherein the amount of phosphate ester added to the crude oil is from 10 to 50 ppm.

15. A method of claim 14 wherein the amount of polysulfide added to the crude oil is from 10 to 50 ppm.

* * * * *